US005623715A

United States Patent [19]

Clark

[11] Patent Number: 5,623,715

[45] Date of Patent: Apr. 22, 1997

[54] LIQUID TONER CONCENTRATE MANAGEMENT SYSTEM AND METHOD

[76] Inventor: Lloyd D. Clark, 15 Conrad St., San Francisco, Calif. 94131

[21] Appl. No.: 294,942

[22] Filed: Aug. 23, 1994

[51] Int. Cl.[6] ..... G03G 15/10

[52] U.S. Cl. ..... 399/57; 399/60; 399/238; 222/309

[58] Field of Search ..... 355/256, 257, 355/258; 118/659, 660; 222/63, 333, 309

[56] References Cited

U.S. PATENT DOCUMENTS

| | | | |
|---|---|---|---|
| 3,912,127 | 10/1975 | Georgi | 222/309 |
| 4,281,620 | 8/1981 | McChesney et al. | 118/660 X |
| 4,331,262 | 5/1982 | Snyder | 222/37 |
| 4,398,818 | 8/1983 | Jeromin et al. | 355/10 |
| 4,428,511 | 1/1984 | Howell | 222/309 |
| 4,519,695 | 5/1985 | Murai et al. | 355/77 |
| 4,580,699 | 4/1986 | Black et al. | 222/64 |
| 4,660,152 | 4/1987 | Downing | 364/509 |
| 4,671,309 | 6/1987 | Iemura et al. | 137/93 |
| 4,675,696 | 6/1987 | Suzuki | 346/46 |
| 4,827,279 | 5/1989 | Lubinsky et al. | 346/1.1 |
| 4,831,420 | 5/1989 | Walsh et al. | 355/203 |
| 4,878,601 | 11/1989 | Flemming et al. | 222/137 |
| 4,894,685 | 1/1990 | Shoji | 355/246 |
| 4,929,978 | 5/1990 | Kanamori et al. | 355/38 |
| 4,994,860 | 2/1991 | Lunde et al. | 355/256 |
| 5,003,352 | 3/1991 | Duchesne et al. | 355/256 |
| 5,155,528 | 10/1992 | Morishige et al. | 355/208 |
| 5,189,521 | 2/1993 | Ohtsubo et al. | 355/246 |
| 5,208,637 | 5/1993 | Landa | 355/256 |
| 5,212,029 | 5/1993 | Scheuer et al. | 355/246 |
| 5,228,594 | 7/1993 | Aslin | 222/63 |
| 5,369,476 | 11/1994 | Bowers et al. | 355/256 |

FOREIGN PATENT DOCUMENTS

| | | | |
|---|---|---|---|
| 52-025637 | 2/1977 | Japan | 355/256 |
| 4141682 | 5/1992 | Japan | 355/256 |

*Primary Examiner*—Robert Beatty

[57] ABSTRACT

An hydraulic cylinder (100) driven by a reciprocating motive force operates in conjunction with two check valves (170) and (200) to pump liquid toner concentrate (150) around a loop from a reservoir bottle (180) and back into the bottle (180). A microprocessor circuit (230) analyzes commands and data bytes representative of the number and color of pixels transmitted from a computer (290) to an electrographic printer (280). When a predetermined pixel count has been reached, a microprocessor circuit (230), acting on positional information obtained from an optical sensor (240) and marks (250) and (260) on a wheel (160), causes a previously calculated volume of concentrate (150) to be added to a toner premix stream or reservoir in printer (280), thus replacing toner particles depleted from toner premix in the printer (280) during printing. The wheel (160) can run continuously to provide a stirring action for the concentrate (150).

20 Claims, 3 Drawing Sheets

LIQUID TONER CONCENTRATE MANAGEMENT SYSTEM AND METHOD

BACKGROUND—CROSS-REFERENCE TO RELATED APPLICATION

This invention contains one or more, improvements over my pending application, Ser. No. 07/826,600, filed Jan. 28, 1992, now U.S. Pat. No. 5,369,476, granted.

BACKGROUND—FIELD OF THE INVENTION

This invention relates to web printing technology, particularly to the maintenance of concentration of pigment, dye, or other particles and chemicals in liquid toner used in electrographic printers.

BACKGROUND—PRIOR ART—GENERAL ELECTROGRAPHIC PRINTING

In a liquid electrographic printing process, such as used to print graphic images, an electrographic medium such as paper, film, vellum, etc. is electrostatically charged on one surface in a pattern of an image to be printed. The charged surface of the medium is then flooded with liquid toner premix. The toner premix comprises a number of components including a slurry of minute pigment, dye or other particles which are electrically charged, plastic resins, buffer compounds, etc. The charge on the particles has an opposite polarity to the image-wise charge previously deposited on the electrographic medium. The particles in the toner premix therefore adhere to image-wise charged areas on the medium in well-known fashion. The image is thus said to be "developed." Multi-color images are printed using successive charging and toning steps. Electrographic printers which operate in this manner are manufactured and sold by Xerox Engineering Systems, Inc. (XES), in San Jose, Calif. A typical electrographic printer of this type deposits toner particles in minute regions, called picture elements or "pixels". In the XES Model 8954-400, for example, pixels are approximately 0.076 mm (0.003 inch) in diameter. They can be deposited on the medium at a density of 157 per cm (400 pixels per inch). Therefore an area of 100 square centimeters can contain 2,480,005 pixels.

During the deposition of toner particles onto the charged areas of the medium, the concentration of these particles in the liquid toner premix stream decreases. Since only the pigment particles are deposited on the receiving medium and only a very small amount of the liquid vehicle remains on the medium, the remaining liquid volume contains fewer toner particles as more image surface is developed. After some period of use, and with a finite reservoir of particles, the liquid toner premix will no longer contain sufficient particles to leave a fully-developed image on the medium. At this point, the toner premix is said to be "depleted." In order to avoid depletion of particles in the liquid toner premix, a toner "concentrate" is provided. Small amounts, on the order of tens of cubic centimeters, of this concentrate are added periodically to the liquid toner (called the "toner premix" to avoid confusion with the "toner concentrate"). Thus the concentration of pigment or dye particles and other chemicals in the toner premix can be maintained at a constant level, resulting in developed or printed images which are of consistent optical density. As graphic arts applications have demanded higher quality images over time, the requirement for accurately controlling the concentration of imaging substances in the toner has become more demanding. Thus toner concentrate must be added to toner premix more frequently and in smaller, more precise volumes today than in the past.

Prior Art—FIG. 1—Toner Concentrate Addition System

Prior-art liquid toner concentrate addition systems typically use suction provided by a toner pump to move toner concentrate from the concentrate reservoir bottle into the toner premix stream. One such prior-art suction scheme is taught in U.S. Pat. No. 4,660,152 to R. A. Downing and L. K. Hansen (1987). The Downing-Hansen device is shown in FIG. 1. Downing teaches a system which is useful with toner premixes containing pigment particles which absorb light of a certain wavelength. An opto-electronic sensing system 42 measures the optical density of pigment particles (not identified) in toner premix 16 as it passes through conduit 36, flow cell 40, and conduit 38. Upon command from sensing system 42 and related circuitry and logical algorithms contained in main data processor 11, auto concentrate control system 70, and system controller 75, control relay 32 causes solenoid valve 30 to open for a period of time. Motion of toner premix 16 through conduit 20 causes a suction at conduit 29. When valve 30 is open, toner concentrate 14 is drawn out of bottle 28 through conduit 29 and valve 30. This concentrate joins the main toner premix stream in conduit 20 and subsequently is mixed with toner premix 16. The servomechanism comprising all these components attempts to maintain the concentration of particles and chemicals in toner premix 16 at a constant level. However because of numerous deficiencies in the design of this system, the volume of concentrate thus added is not known precisely.

Even if concentration sensing system 42 were precise in its determination of the conditions calling for addition of concentrate 14, this system fails to accurately meter a known volume of toner concentrate 14 into conduit 20 and thence into toner premix 16. This inaccuracy is caused by variability in the suction in conduit 29. This variability can result from variations in the speed of the motor (not shown) which drives pump 22, constrictions in the plumbing of conduits 20 and 29, etc.

Furthermore, in this system the concentrate bottle is static and no provision is made for stirring the slurry of particles in toner concentrate 14. Thus the particles in toner concentrate 14 can settle to the bottom of bottle 28. Since the end of conduit 29 is located at the center of bottle 28, it is probable that much of the slurry in toner concentrate 14 may never be removed from the outer circumference at the bottom of bottle 28. This lack of stirring causes uncertainties and variations in the concentration of toner concentrate 14 which is delivered to toner premix 16 via conduit 29. While this system has been adequate in the past, it does not meet the stringent requirements of the present or the future. This system is also relatively large, being distributed over a volume of approximately 56,634 cc (3,456 cubic inches). Its weight is not known. However because it is installed in the printer in a distributed fashion, it is not easily portable nor is it suitable for adaptation to other brands of printer.

Prior Art-FIG. 2—Partially Improved Toner Concentrate Addition System

In my co-pending application, an improved system is shown which uses a positive-flow pump 33'—i.e. a vane pump, rather than a centrifugal pump—to pump the toner concentrate in a loop or circuit from concentrate bottle 32' and back. A "three-way" solenoid ejection valve 34' is placed in this loop. In its "un-energized" condition, ejection valve 34' conducts the flow from concentrate bottle 32' and back into the same concentrate bottle. In its "energized" condition, valve 34, diverts flow of the concentrate into the toner premix stream via tee fitting 36', instead of back to the concentrate bottle. If the flow rate of the concentrate in the loop is known and if the "diverting" time of valve 34' is known, then it is possible to determine the amount of concentrate which is "diverted" or added to the premix stream.

While this system is a great improvement, it has at least two sources of inaccuracy. First, the speed of the motor (not shown) which drives pump 33' may not be constant over time. The motor speed depends on the load applied to the motor. In addition to the more or less steady load due to pumping of the concentrate, some sources of loading can vary with time including friction, wear, clogging of the pump and pipes, etc. These can cause the pump motor speed to vary, which in turn causes an uncertainty in the flow rate through the concentrate loop. Another source of error is to be found in estimating the amount of time valve 34' is actually open when it is in its "energized" condition. A valve's opening or actuating time is typically on the order of ten to twenty milliseconds after the energizing voltage is applied. A valve's closing time is typically twenty to twenty-five milliseconds after the energizing voltage is removed. If the duration of the energizing voltage pulse is short, on the order of twenty to forty milliseconds, a significant error can occur in estimating the amount of concentrate which is added to the premix stream. Furthermore, the pumps and motors which comprise this system are expensive. The pumps typically cost $200 each, the motors cost on the order of $50 each, and the solenoid valves cost on the order of $50 each. Thus the cost of the major plumbing pans for a four-color concentrate addition system of this type is at least $1,200. This system occupies about 55,306 cc (3,375 cubic inches) and weighs about 16.3 kg (thirty-six pounds), exclusive of an exterior cabinet. Again, because of its size and weight, it is not easily portable nor is it easily adapted for use in printers of various brands and designs.

OBJECTS AND ADVANTAGES

Accordingly several objects and advantages of the present invention are to provide a more accurate and precise fluid metering system for use in electrographic printers and elsewhere. Another object is to provide an accurate and precise fluid metering system which is less expensive than prior-an systems. Yet other objects are to provide an accurate and precise fluid metering system which is less expensive, more compact and lighter-weight than prior-art systems, to provide an accurate and precise fluid metering system which constantly pumps the fluid to be metered around a loop in order to keep it stirred, and on demand causes the fluid to be diverted from this loop in order to be expelled from the loop and added to another fluid stream or reservoir, and to provide a fluid metering system which is small and easily portable and which can be mounted in or on printers of various brands and configurations.

Additional objects and advantages will become apparent from a consideration of the drawings and ensuing description thereof.

SUMMARY

In accordance with the present invention, a low-cost fluid metering system accurately and precisely meters known quantities of liquid toner concentrate on demand into a second, toner premix stream or reservoir.

DRAWING FIGURE REFERENCE NUMERALS

FIG. 1—Prior Art

| | |
|---|---|
| 11 | Main data processor |
| 14 | Toner concentrate |
| 16 | Toner premix |
| 20 | Conduit |
| 22 | Pump |
| 28 | Bottle |
| 29 | Conduit |
| 30 | Solenoid valve |
| 32 | Control relay |
| 36 | Conduit |
| 38 | Conduit |
| 40 | Flow cell |
| 42 | Opto-electronic measuring system |
| 70 | Auto concentrate control system |
| 75 | System controller |

FIG. 2—Prior Art

| | |
|---|---|
| 33' | Pump |
| 32' | Concentrate bottle |
| 34' | Solenoid valve |
| 36' | Tee fitting |

Figure 1:
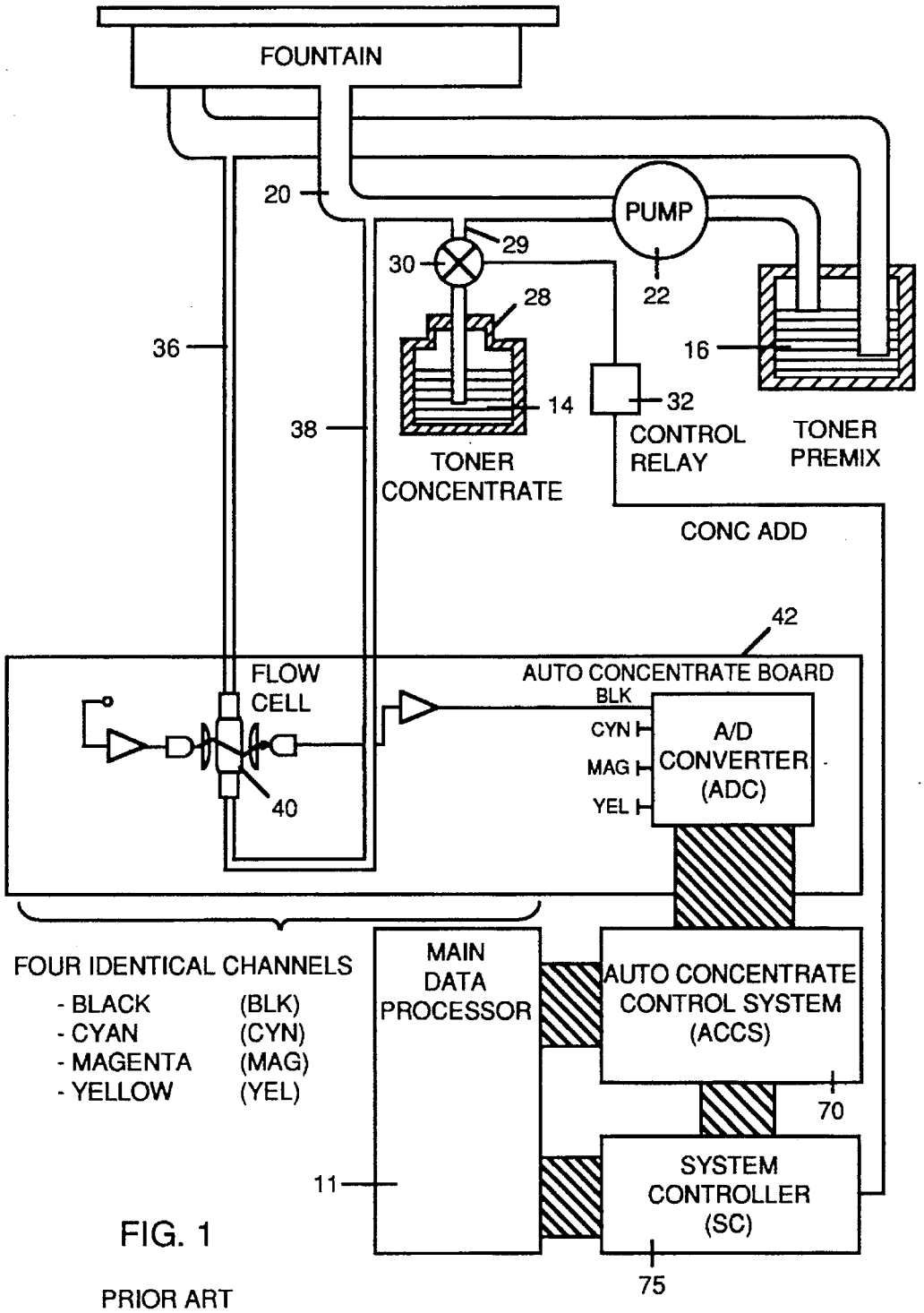
FIG. 1 PRIOR ART
FIG. 1 is a schematic diagram of a prior-art liquid toner concentrate addition system.
Figure 2:
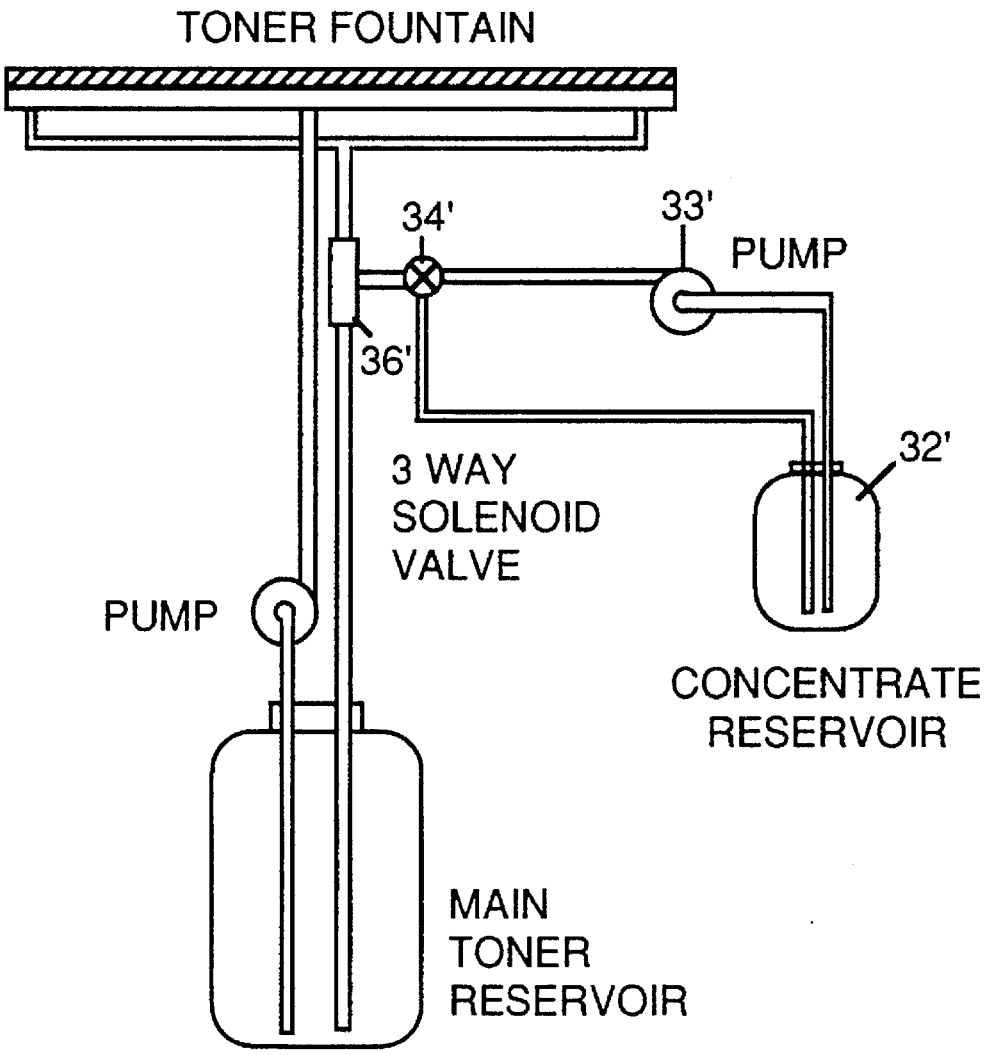
FIG. 2 PRIOR ART
FIG. 2 is a schematic diagram of an improved prior-art liquid toner concentrate addition system.
Figure 3:
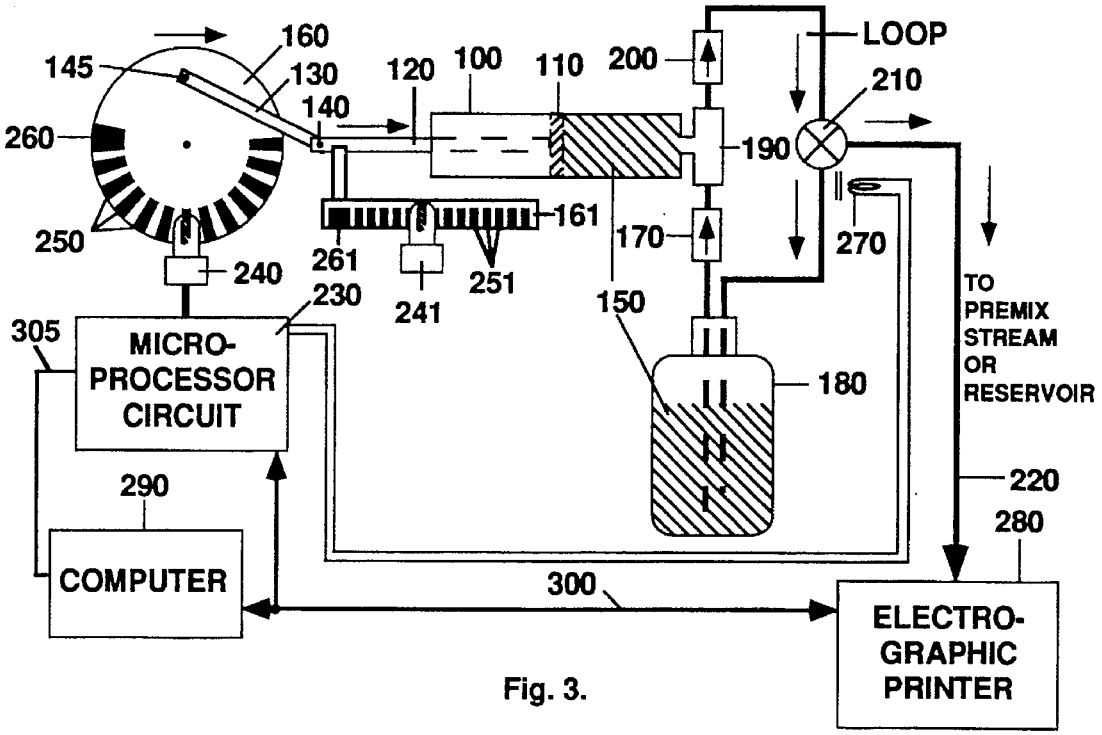
FIG. 3 is a schematic diagram of a preferred embodiment of the present system.

FIG. 3—Preferred embodiment of the Present Invention

| | |
|---|---|
| 100 | Hydraulic cylinder |
| 110 | Piston |
| 120 | Rod |
| 130 | Rod |
| 140 | Pivot |
| 145 | Pivot |
| 150 | Toner concentrate |
| 160 | Wheel |
| 161 | Flag |
| 170 | Check valve |
| 180 | Toner concentrate bottle |
| 190 | Tee fitting |
| 200 | Check valve |
| 210 | Three-way solenoid valve |
| 220 | Conduit |
| 230 | Microprocessor circuit |
| 240 | Opto-electronic sensor |
| 241 | Opto-electronic sensor |
| 250 | Marks or slots |
| 251 | Marks or slots |
| 260 | First mark or slot |
| 261 | First mark or slot |
| 270 | Coil |
| 280 | Printer |
| 290 | Computer |
| 300 | Cable |
| 305 | Serial Port Connection |

Figure 4:
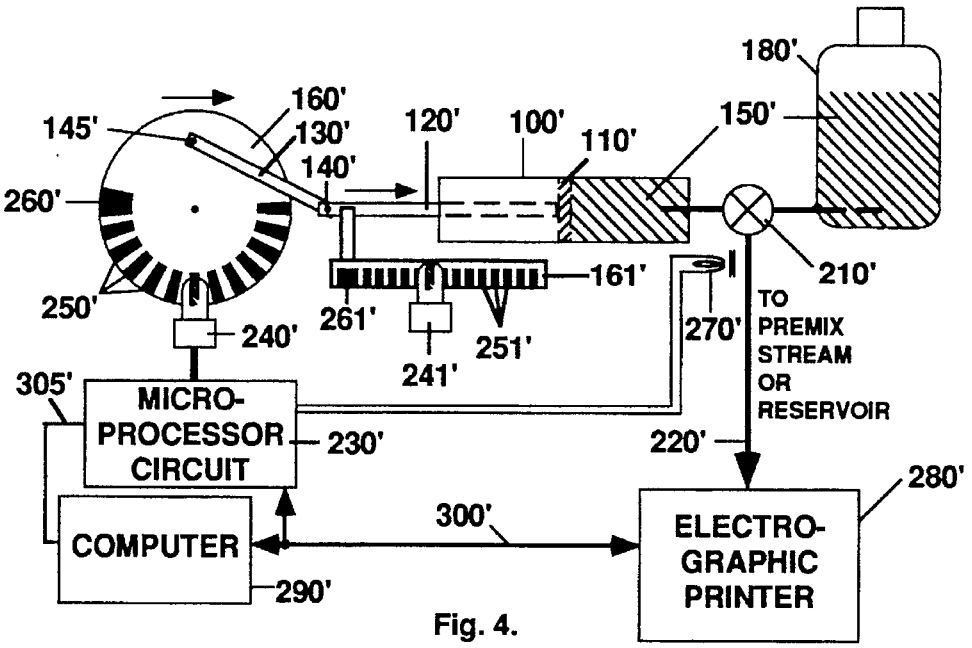
FIG. 4 is a schematic diagram of an alternative embodiment of the present system.

FIG. 4—Alternative Embodiment of the Present System

| | |
|---|---|
| 100' | Hydraulic cylinder |
| 110' | Piston |
| 120' | Rod |
| 130' | Rod |
| 140' | Pivot |
| 145' | Pivot |
| 150' | Toner concentrate |
| 160' | Wheel |
| 161' | Flag |
| 180' | Toner concentrate bottle |
| 210' | Three-way solenoid valve |
| 220' | Conduit |
| 230' | Microprocessor circuit |
| 240' | Opto-electronic sensor |
| 241' | Opto-electronic sensor |
| 250' | Marks or slots |
| 251' | Marks or slots |
| 260' | First mark or slot |
| 261' | First mark or slot |
| 270' | Coil |
| 280' | Printer |
| 290' | Computer |
| 300' | Cable |
| 305' | Serial Port Connection |

Toner Concentrate Addition and Agitation System, Preferred Embodiment—FIG. 3.

A presently preferred embodiment of the present system as applied to electrographic printing equipment is shown in FIG. 3. The present system comprises a novel combination of plumbing and electrical and electronic components. In one preferred embodiment, a precise replacement volume of toner concentrate is added to the premix stream or reservoir after a known volume of toner solids has been deposited on the medium, and thus removed from the toner premix. This known volume Of toner solids is determined by a simple calibration procedure described infra. The present system overcomes the inaccuracies inherent in prior-art designs. It also is far less expensive to manufacture and potentially more reliable because it contains fewer parts.

OVERALL SYSTEM—FIG. 3

The present system uses a "pump" comprising a hydraulic cylinder 100. A piston 110 is connected by rods 120 and 130 to an external driving force comprising wheel 160 and a rotary motive force or motor (not shown). Wheel 160 rotates clockwise at a steady rate of approximately 10 revolutions per minute. When urged by connecting rod 130, which is connected to rod 120 by pivot 140 and to wheel 160 by pivot 145, piston 110 causes toner concentrate fluid 150 to be forcibly ejected from cylinder 100. Check valves 170 and 200 pass fluid on one direction only, as shown by the arrows on the valves. Check valves are well known and understood by those familiar with fluid handling devices. Check valve 170 prevents retrograde flow from cylinder 100 into concentrate bottle 180. Instead, concentrate 150 is forced to flow through tee fitting 190 and out through check valve 200. After concentrate 150 has passed through valve 200, it continues around the loop, passing through "un-energized" solenoid ejection valve 210 on its way back to concentrate bottle 180. When rod 130 reaches its rightmost position, most of the contents of cylinder 100 will have been expelled.

As the rotation of wheel 160 continues, the direction of motion of piston 110 will be reversed. When piston 110 is forcibly pulled to the left through the action of wheel 160, concentrate 50 is drawn by suction through check valve 170 and tee 190 and finally into cylinder 100. Retrograde flow around the 10op is now prevented by check valve 200. Thus as wheel 160 rotates, causing piston 110 to Oscillate in position from one end of cylinder 100 to the other, concentrate 150 is pumped discontinuously around the loop in the direction shown.

Periodically, it is desirable to add concentrate in accurate and precisely controlled amounts to the toner premix stream or a toner premix reservoir (not shown). Three-way solenoid ejection valve 210 is provided for this purpose. While valve 210 is in its "unenergized" state, concentrate 150 flows around the loop and back into concentrate bottle 180, as described above. When valve 210 is in its "energized" or "actuated" state, the flow of concentrate 150 no longer returns to bottle 180, but instead is forced outward through conduit 220 and into the premix stream. The timing of the energizing voltage applied to valve 210 is controlled by microprocessor circuit 230.

ELECTRONIC COMPONENTS—FIG. 3

The configuration of the electronics and its connection to valve 210 in this preferred embodiment is as follows. An opto-electronic sensor 240 is employed to sense the passage of marks or slots 250 and 260 in wheel 160 as it rotates. The first slot 260 encountered by sensor 240 is an indexing slot which is wider than subsequent slots 250. Electronic circuitry (not shown) detects this indexing Slot and sends to microprocessor circuit 230 a signal which is uniquely indicative of the passage of mark 260. Circuit 230 contains a Programmable, Read-Only Memory (PROM) (not shown) which contains instructions upon which microprocessor circuit 230 acts. The signal associated with the passage of mark 260 causes an "interrupt" signal to be applied to microprocessor circuit 230 in well known fashion. Microprocessor 230 then counts the remaining marks on wheel 160 and thereby accurately knows the angular position of wheel 160 and therefore the displacement of piston 100 from the starting position signaled by mark 260. Because of the cycloidal motion of pivot 145 which moves rod 130, the velocity of piston 110 will be sinusoidal. For convenience in counting, the width and spacing of slots or marks 250 varies sinusoidally to provide counts which are representative of equal volume increments as wheel 160 rotates.

When the addition of concentrate 150 to the premix stream is required, microprocessor 230 energizes valve 210, when appropriate after indexing slot 260 has been detected, by passing current through coil 270. The duration of this energizing pulse is determined by the number of marks 250 which are detected by opto-electronic sensor 240 and counted by microprocessor 230. The smallest volume of concentrate which is added to the premix stream is typically represented by the distance from the start of one mark 250 to the start of the next. This volume is as little as 0.1 cc. Preferably this volume is standardized at 1 cc. The preferred diameter of piston 110 is 1.91 cm. One cc of fluid will have been pumped when piston 110 has moved 0.349 cm.

CALIBRATION—FIG. 3

The calibration procedure for determining the number of bytes to be counted by microprocessor 230 before actuating valve 210 is determined as follows. A test print of the copy to be printed is made on an electrographic medium using an electrographic printer as described above. This print is made using a new, fresh batch of toner premix. The print consists of solid areas of each primary color to be printed, typically cyan, magenta, yellow, and black. A section, approximately 5×5 cm of the printed medium is obtained for each color and for an adjacent toned but not printed area. This latter piece is used as a standard against which the colored pieces are to be compared. These five pieces of printed medium are all cut to exactly the same size. They are then weighed separately using an analytical scale or balance. In the example and with the parameters given, each colored piece will weigh 246 milligrams. The non-colored piece will weigh 237 milligrams. The difference in the weight, nine milligrams, between each colored piece and the non-colored piece is a measure of the weight of toner particles removed from the slurry in the premix stream and deposited on that piece of medium. From this measurement the weight of toner deposited per unit area is determined to be 0.38 milligram/$cm^2$ for each of the primary colors printed. If 1 $cm^2$ contains 24,480 pixels, then there are $6.4\times10^7$ pixels per gram of solids.

The concentration of toner premix and toner concentrate is generally specified in terms of percent solids by weight. These solids primarily comprise the toner pigment or dye particles in the slurry. In the example given, a concentration of toner concentrate is 12% solids, by weight and a concentration of toner premix is 2% solids, by weight. One cc of toner concentrate weighs 0.75 g. The contribution of solids to this weight is thus 0.09 gram. The correspondence between the volume of concentrate to be added in order to compensate for the printing of a given number of pixels is thus calculated as follows: since the amount of concentrate to be added equals 1 cc, and each cubic centimeter of concentrate contains 0.068 gram of solids and $6.4\times10^7$ pixels weighs one gram, then one cubic centimeter of concentrate must be added for every $4.35\times10^6$ pixels printed. The above method can be used for systems with other parameters, such as different toner weights, different test section sizes, etc.

PRINTING AND TONER CONCENTRATE ADDITION—FIG. 3

Computer 290 is used by the prior-art systems and the present system. It sends pictorial information to electrographic printer 280 via cable 300. In the present system, computer 290 contains a co-resident program which can send information to and receive information from microprocessor circuit 230 via serial port connection 305. Typically, the primary colors to be printed by printer 280 are sent by computer 290 sequentially in layers. The first color layer is typically black. A signal from computer 290 is sent to printer 280 which tells printer 280 to print the following layer in black. When printer 280 is ready to receive data, the rastefized image data are sent to printer 280 from computer 290 in well-known fashion. Each byte of data sent from Computer 290 to printer 280 is representative of the information to be printed on a pixel-by-pixel basis. Microprocessor circuit 230 is connected to computer 290 by a parallel-connected branch of cable 300 and serial port connection 305. Microprocessor 230 is programmed to decode the byte information sent from computer 290 to printer 280 via cable 300 in order to maintain a count of the number of pixels as they are transmitted to printer 280.

Computer 290 is programmed to send previously computed preset pixel counts to microprocessor 230. These pixel counts can be manually entered on the keyboard of computer 290 or calculated using data which are manually entered and the result transmitted to microprocessor 230 via serial port connection 305. In the present example, the preset pixel count is $4.35\times10^6$ pixels. When microprocessor 230 reaches a pixel count equal to the preset pixel count, it resets the pixel counter (not shown) and enters a branch of its program which causes a predetermined amount of concentrate 150 to be added to the premix stream or reservoir in printer 280. Pixel counting continues while concentrate is being added to the premix stream or reservoir.

When microprocessor 230 has counted $4.35\times10^6$ pixels, equal to the preset amount, this indicates—using the parameters discussed and calculated—that one cc of toner concentrate will have been used in printing. Thus 1 cc of toner concentrate 150 must be added to the premix stream or to the premix reservoir. Upon reaching the count of $4.35\times10^6$ pixels, a part of the algorithm storm in microprocessor 230 determines the position of continuously rotating wheel 160. If sufficient travel remains in the current revolution of wheel 160, and therefore the stroke of piston 110, to deliver exactly 1 cc of toner concentrate, as determined by the number of counts remaining, then microprocessor 230 will energize coil 270, causing solenoid valve 210 to actuate. As explained supra, this actuation will cause toner concentrate to be pumped into the premix stream or reservoir.

When sufficient marks 250 have been counted, corresponding to the expulsion of 1 cc of toner concentrate into the premix stream or reservoir, then microprocessor 230 will remove the energizing current from coil 270 and toner concentrate flow will revert to bottle 180.

If insufficient travel remains in the current revolution of wheel 160 to deliver the required 1 cc of toner concentrate, then microprocessor 230 will simply wait until the next forward pumping cycle, as indicated by the passage of mark 260. Different preset pixel count values can be entered in the memory of microprocessor 230 via serial port 305. Information about the operation of microprocessor 230, contents of registers, etc. can be transmitted from microprocessor 230 to computer 290. This information includes indications of error conditions such as jamming of piston 110 which causes the count output from sensor 240 to stop unexpectedly, etc.

Computer 290 or 290' typically contains more components, has a larger memory than microprocessor circuit 230 or 230', and has a large storage device, such as a multi-megabyte hard disk. The signal which causes concentrate 150 to be added to the premix stream or the premix reservoir can be calculated by computer 290 or 290' and relayed to microprocessor 230 over cable 300 or 300' or via serial port connection 305.

The volume of each addition of toner concentrate can be changed by varying the number of marks 250 counted for each actuation of valve 210. The interval between additions of toner concentrate to the premix stream can be changed by varying the number of pixels to be counted between actuations.

In a typical system, the diameter of piston 110 is 19.1 cm and its stroke is 10 cm. The diameter of wheel 160 is 6.4 cm. Wheel 160 rotates at 10 RPM. Rod 130 is 6.4 cm long. Tee fitting 190, check valves 170 and 200 and valve 210 have orifices commensurate in diameter with normal ⅛-inch (3.2 mm) N.P.T. threading. Bottle 180 contains one liter of concentrate 150. The size of marks 250 and 260 depends on the accuracy required of the system. They range from a fraction of a millimeter to several millimeters in width. Preferably 0.2 mm width marks are used.

This preferred system can run continuously, causing the fluid in bottle 180 to recirculate. This recirculation can keep particles in the fluid in continuous suspension, thus ensuring delivery of precisely known quantities of toner particles in each volume dispensed. This constant agitation overcomes the disadvantage of prior-art methods which stir the slurry only occasionally or not at all. With this system the premix stream toner is replenished and its concentration kept consent automatically so that even printing will occur with no manual intervention.

Although the preferred system runs continuously, it can also be stopped and run periodically when it is desired to stir or to eject concentrate 150.

The preferred system is very inexpensive to manufacture and is small in size and weight. A suitable motor costs approximately $25. A slotted or marked wheel costs about $10. Connecting rods and pivots cost about $10. Each piston costs about $25 and the check valves cost about $10. The tee fitting costs about $2. A three-way solenoid valve costs about $50. For a four-color system, the plumbing parts cost is thus approximately $443. The microprocessor and associated circuitry cost about $200. This preferred embodiment occupies about 6,293 cc (384 cubic inches) and weighs approximately ten pounds, including an exterior cabinet.

Alternative Embodiment—FIG. 4

An alternative embodiment is shown in FIG. 4. Although this embodiment requires fewer parts than the first preferred embodiment, it operates in substantially the same manner. Instead of a concentrate loop, concentrate is pumped through a conduit containing valve 210' into and out of bottle 180' as wheel 160' turns. In order to prevent an accumulation of air in pneumatic cylinder 100', the plumbing connection to bottle 180' must be located at the bottom of bottle 180'. Concentrate 150' is added to the premix stream or reservoir (not shown) in electrographic printer 280' through conduit 220' in the same manner and with the same timing as described above in the case of the first preferred embodiment. For a four-color system, the major plumbing and mechanical parts of this embodiment cost approximately $401. This alternative embodiment also occupies about 6,293 cc (384 cubic inches).

Summary, Ramifications and Scope

It is thus seen that the present system provides a simple, inexpensive way to agitate a fluid by pumping it from a reservoir, preferably though not necessarily through a loop, and thence back into the reservoir, and for metering accurate and precisely controlled amounts of the fluid into a secondary fluid Stream or reservoir through the action of a three-way valve. This system can be made to be responsive to pixel count information, representative of an amount of solids removed from a liquid toner slurry during electrographic printing. The pixel count information can be obtained by a stand-alone microprocessor or from a host computer. The pixel count information can be varied in order to cause the system to divert fluid from the loop more or less frequently. The number of marks or slots counted on a reference wheel can be varied in order to vary the amount of fluid expelled through a solenoid valve when the valve is in its actuated state. The present system provides greatly improved accuracy and precision over prior-art systems. Its structure is simpler than the prior-art systems and hence more reliable and less expensive. It is smaller and lighter in weight and is more easily adaptable to a wide variety of printers. Since it is less expensive, smaller, and lighter, yet has better performance than prior-art systems, it should enjoy considerable success in the marketplace.

Although several embodiments of the system have been described, and specific details have been disclosed, these can be varied and modified within the scope of the invention. For example, by the simple ganging of cylinders, the pumping system shown can use a single drive wheel and motor to move the pistons in more than one hydraulic cylinder. This results in a proliferation of the number of pumping stations while still using only one motive force, thus saving cost and fostering simplicity of construction. In a multi-color system, the number of counts of each type can be different for each of the primary colors.

Instead of wheel 160 with sensing marks 250 and 260, a flag 161, which is solidly attached to rod 120, can be provided with a linear arrangement of marks 251 and 261. Marks 251 and 261 are sensed by sensor 241.

Instead of a motor, wheel and connecting rod the motive force which drives the pistons in the hydraulic cylinders can be a 10 near motor, or it can be a motor-powered, screw drive in which the pistons are driven into the cylinders when the motor turns in one direction, and out of the cylinders when the motor is reversed. In the case of a linear drive, fiducial marks for counting by microprocessor circuit 230 can be placed on rod 120 or on a flag affixed to rod 120. Numerous other drive methods are possible. For example, an hydraulic or pneumatic cylinder driven by in external source of fluid could provide the motive force required to move piston 110.

Instead of transmitting the preset pixel count from computer 290 to microprocessor circuit 230 via serial port 305, a knob or thumbwheel switch (not shown) can be provided in microprocessor circuit 230 for manual entry of preset counts.

Although the system shown can meter minute amounts of fluid into conduit 220 or 220', it is also capable of expelling the entire volume of the cylinder on each stroke. This volume is selected by adjusting the mark of slot count. Thus very small or very large fluid volumes can be dispensed.

If a very small volume of fluid is to be expelled from valve 210, its energized time may be very short. Any potential inaccuracies in the volume expelled due to variations in actuation time of solenoid valve 210 can be reduced by causing the valve to open near the extremes of the stroke of piston 110 when the velocity of piston 110 is at a minimum.

Fluids other than liquid toner concentrate can be stirred and accurately metered by this system.

While the present system employs elements which are well known to those skilled in the separate arts of fluid dynamics, mechanical engineering and electronic engineering, it combines elements from these fields in a novel way which produces a new result not heretofore discovered.

Accordingly the scope of this invention should be determined not by the embodiments illustrated, but by the appended claims and their legal equivalents.

I claim:

1. A fluid pumping system, comprising:

(a) motive means providing a motive force, (b) a pump containing a cyclically movable driving member which is arranged to eject from said pump, when said pump contains fluid, a known volume of fluid in each cycle of operation, the volume of fluid being proportional to the travel of said driving member, (c) coupling means for coupling said motive means to said pump so that said motive means forces said pump to operate, (d) a loop containing a fluid reservoir, said loop connected to said pump so that fluid, when present in said pump and said conduit, recirculates between said pump and said reservoir in response to said operation of said pump, (e) check valve means for restricting fluid flow around said loop to a single, predetermined direction, (f) measuring means for determining the position of said driving member, and (g) eject valve means for intermittently causing some of said fluid to be expelled from said loop.

2. The system of claim 1 wherein said eject valve means is a solenoid valve.

3. The system of claim 2, further including a microprocessor circuit for intermittently activating said solenoid valve.

4. The system of claim 2, further including a printing system and a computer for controlling said printing system, said computer also being arranged to actuate said solenoid valve intermittently.

5. The system of claim 3, further including means for controlling the timing of actuation of said solenoid valve in response to said position.

6. The system of claim 1 wherein said pump is a piston pump and said cyclically movable driving member is a piston.

7. The system of claim 6, further including a printing system and a computer for controlling said printing system, said computer also being arranged to actuate said eject valve means intermittently.

8. The system of claim 6, further including means for controlling the timing of actuation of said eject valve means in response to said position.

9. The system of claim 1, further including controlling means, responsive to said measuring means for operating said eject valve means for a duration related to the travel of said driving member.

10. The system of claim 9, further including a printing system and a computer for controlling said printing system, said computer also being arranged to actuate said eject valve means intermittently, wherein said controlling means is responsive to a parameter in said printing system.

11. The system of claim 1, wherein said pump is arranged to agitate said fluid periodically.

12. A fluid pumping system, comprising (a) motive means providing a motive force, (b) a pump containing a cyclically movable driving member which is arranged to eject from said pump, when said pump contains fluid, a known volume of fluid in each cycle of operation, the volume of fluid being proportional to the travel of said driving member, (c) coupling means for coupling said motive means to said pump so that said motive means forces said pump to operate, (d) a conduit and a fluid reservoir, said conduit connecting said fluid reservoir to said pump for allowing said fluid, when present in said pump and said conduit, to recirculate from said reservoir to said conduit and back to said reservoir in response to said pump, (e) measuring means for determining the position of said driving member, and (f) eject valve means for intermittently causing some of said fluid which recirculates to be expelled from said conduit.

13. The system of claim 12 wherein said valve means is a solenoid valve.

14. The system of claim 13, further including a microprocessor circuit for intermittently activating said solenoid valve.

15. The system of claim 13, further including a printing system and a computer for controlling said printing system, said computer also being arranged to actuate said solenoid valve intermittently.

16. The system of claim 13, further including means for controlling the timing of actuation of said solenoid valve in response to said position.

17. The system of claim 12, wherein said pump is arranged to agitate said fluid periodically.

18. A method of toner replenishment, comprising:

providing an electrographic printer arranged to deposit toner components from a premix containing toner components and carrier onto a printing medium, said printer arranged to deposit said toner components on a medium in a predetermined printing pattern, determining, for said predetermined printing pattern, the rate at which said toner components are removed from said premix and are deposited onto said printing medium, providing a cyclically movable driving member for pumping a toner concentrate, providing a conduit for periodically recirculating said toner concentrate to and from a reservoir under the action of said movable driving member, providing toner concentrate addition means, responsive to measurement of the travel of said cyclically movable driving member, for replenishing said toner concentrate into said toner premix at a predeterminable rate by periodically gating a predetermined quantity of toner concentrate pumped by said driving member into said premix, and adjusting said toner concentrate addition means so that it adds toner concentrate to said toner premix at a rate which keeps the concentration of said toner components in said toner premix substantially constant.

19. The method of claim 16, further including determining said rate of addition of said recirculated toner concentrate by comparing the weight of said printing medium with and without said predetermined printing pattern.

20. The method of claim 18, further including determining said predetermined quantity of toner components by measuring the weight percentage of said toner components in said toner concentrate.

* * * * *